United States Patent [19]

Tomlinson, II

[11] 4,011,129

[45] Mar. 8, 1977

[54] PULP MILL RECOVERY SYSTEM

[75] Inventor: George Herbert Tomlinson, II, Ile Perrot, Canada

[73] Assignee: Domtar Limited, Montreal, Canada

[22] Filed: Apr. 11, 1975

[21] Appl. No.: 567,473

[52] U.S. Cl. ..... 162/30 K; 162/33

[51] Int. Cl.[2] ..... D21C 11/04; D21C 11/12

[58] Field of Search ..... 162/17, 30, 33, 35; 210/63; 423/207

[56] References Cited

UNITED STATES PATENTS

| | | | |
|---|---|---|---|
| 1,808,773 | 6/1931 | Grondova | 423/207 |
| 2,574,193 | 11/1951 | Savell | 162/30 |
| 3,309,262 | 3/1967 | Copeland et al. | 162/30 |
| 3,366,535 | 1/1968 | Cann | 162/30 |
| 3,523,864 | 8/1970 | Osterman et al. | 162/30 |
| 3,578,396 | 5/1971 | Priestley | 162/30 |
| 3,635,790 | 1/1972 | Heath | 162/30 |
| 3,862,909 | 1/1975 | Copeland | 162/30 |

OTHER PUBLICATIONS

"Elimination of Sulfite Mill Wastes by Fluid Bed Treatment," Copeland et al., American Paper Industry, Mar. 1967.

"Kraft Overload Relief System," Copeland Process Corporation, Prior to 1969.

"New Fluidized Bed System Produces Salcake From Spent NSSC Liquor" Paper Trade Journal p. 43, July 26, 1965.

*Primary Examiner*—S. Leon Bashore
*Assistant Examiner*—Peter F. Kratz
*Attorney, Agent, or Firm*—C. A. Rowley

[57] ABSTRACT

A method of increasing the chemical recovery capacity of a Kraft Recovery Furnace by injecting solid pellets of sodium sulphate and sodium carbonate directly onto the char bed in the reducing zone of the furnace while maintaining the temperature and reducing atmosphere in this zone thereby to form a smelt containing sodium sulphide and sodium carbonate from the injected pellets. These pellets may be produced from a further quantity of balck liquor in an auxiliarly incinerator such as a fluid bed combustion unit. This invention permits increasing the recovery capacity of a furnace without necessitating the construction of a new Recovery Furnace.

4 Claims, 1 Drawing Figure

PULP MILL RECOVERY SYSTEM

FIELD OF THE INVENTION

The present invention relates to recovery of heat and chemicals from waste pulping liquors, more particularly it relates to a system for increasing the capacity of a recovery furnace, i.e. a Kraft Mill Recovery Furnace or the like and to a system for increasing the recovery capacity of an alkaline pulping mill i.e. a Kraft mill.

DESCRIPTION OF THE PRIOR ART

The alkaline pulping process, more particularly the Kraft process is, at least in North America, the single most important process for the production of chemical pulp from cellulosic raw material. In this process, the lignocellulosic material, such as wood chips, is digested at a suitable temperature and pressure with a liquor consisting essentially of sodium hydroxide and sodium sulfide with the sodium in the sulphide constituting about 1/5 to 1/3 the total sodium. When the digestion is completed, cellulose pulp, the desired product, is separated from the residual liquor, and is further processed, as required, through steps of washing, bleaching, drying and so on. The residual liquor, called the "black liquor", contains a great variety of organic compounds dissolved out of the wood during digestion, as well as a valuable amount of sodium and sulphur combined with the organic material or with one another. The recovery phase of the pulping process aims at reconstituting from the black liquor the initial pulping liquor ("white liquor") consisting of sodium hydroxide and sodium sulfide. To this end the black liquor is concentrated to a suitable solids content (e.g. about 55–65%) and, after addition of make-up chemical, e.g. in the form of sodium sulphate, is sprayed into a recovery furnace. The organic constituents of the liquor are substantially completely burnt in the furnace liberating heat, while the major portion of the inorganic components collect on a hearth at the bottom of the furnace and form a smelt consisting essentially of sodium carbonate and sodium sulfide. The heat is recovered from the hot gases of combustion in a boiler section to produce steam. The smelt is dissolved in water and the solution is causticized, e.g. by treatment with lime, to covert the sodium carbonate to sodium hydroxide and thus to reconstitute a solution of sodium hydroxide and sodium sulfide. This is essentially the composition of the pulping liquor used in the process.

A minor portion of the sodium salts entering the furnace (of the order of about 10%) are volatilized as a result of the high temperatures. A portion of these volatilized salts condences on the cooling surface of the furnace and the balance, under normal load conditions, condenses in colloidal form in the furnace gases as the gases are cooled, is carried through the furnace in the gas and subsequently is removed for return to the process by electrostatic precipitators for the like.

Due to improved control of gaseous reduced sulphur emissions from the modern Kraft pulp mill sulphur loss independent of sodium have been greatly decreased and in such cases only a portion of the sodium make up is added in the form of sodium sulfate to the black liquor and the balance is added as sodium hydroxide to the white liquor.

The recovery furnace is so constructed, and the combustion is so controlled, that while high temperatures oxidizing conditions exist in one zone in the furnace, usually in the vicinity of the liquor inlet nozzles, a reducing atmosphere with resultant lower temperature is maintained in the lower part of the furnace in the vicinity of the hearth where the molten inorganic salts are collected and discharged. This reducing atmosphere ensures that a chemical reduction of the sulfur compounds take place with the result that the sodium combined with the sulfur in the smelt is converted to sodium sulfide. Thus the liquor sprayed into the furnace through the inlet nozzles, and still containing a considerable quantity of water first encounters a high temperature strongly oxidizing zone. The intense heat causes the incoming spray of liquor to dehydrate rapidly and the resulting char particles fall, either directly or after an intermediate settling on the walls of the furnace, onto the hearth below. There the residual carbon retained in the dehydrated char is burnt out, under conditions such that a reducing atmosphere is maintained and the molten salts consisting essentially of sodium carbonate and sodium sulphide drain from the furnace. The gases rising from this reducing zone pass through the oxidizing zone above, where their oxidation is completed, thereby generating the heat in the oxidizing zone before they are passed on to the boiler section and out of the furnace complex. Air for the oxidizing zone may be added only as secondary air through ports located below the liquor injection nozzle, or alternatively, through both secondary and tertiary ports with the tertiary ports located above the liquor injection nozzle.

It will be apparent that the temperature in the various zones in the furnace is determined in part by the amount of air injected into the zone and in part by the cooling system provided. Clearly, the total quantity of air entering the furnace should be adequate to allow complete overall combustion of all the organic matter; however, its distribution between the reducing and the oxidation zones must be such as to maintain the reducing conditions on the hearth with a temperature sufficient for the sodium salts to form a smelt. Bearing in mind that sodium salts volatilize at the temperature prevailing in the furnace and that the rate of volatilization is temperature dependent, it is generally preferred that the temperature on the hearth be relatively low but of course compatible with the formation of the smelt. The temperature in the upper section of the furnace, namely the oxidizing zone, is generally higher than the hearth and thus more sodium salts volatilize from this zone.

Because of the presence of volatilized sodium salts in the combustion gases it is necessary to partially cool these gases so that the temperature of the gases, when they enter the super heater and boiler sections of the furnace which are composed of closely spaced tubes, is below the melting point of the salts. This cooling is accomplished by the so-called "water wall" and the construction of the furnace, i.e. the water wall is formed by vertical inter-connected finned tubes which are cooled by circulating water and the shape of the furnace is necessarily high in order to allow time for the gases to cool between the high temperature combustion zone and the boiler tube section located a substantial distance above it. Sodium salts are condensed on the water wall section as a solid phase next to the cooled tubes with a transition to a liquid phase on the hot side. Salts from the liquid phase run down to the hearth. The condensed salts on the wall form an insulating layer between the cooled wall and the interior of the furnace, the thickness of which varies with temperature. Thus, the higher the temperature in the adjacent zone in the furnace the thinner the insulating layer and the greater the cooling and vice versa. By this means the temperature in the boiler section is thereby self regulated to ensure that sodium salts condensing and reforming on the boiler tubes form as a loosely adhering solid similar to one that might be obtained by sublimation and one that may be easily removed by the automatic "soot" blowers which are provided. The automatic temperature control provided by the water wall only functions within certain design limits and thus the degree of combustion overload that can be tolerated is limited.

If the furnace is overloaded the temperature of the gases reaching the boiler section is too high and the sodium salts condense on the boiler tubes as a strongly adhering slag that fouls the operation of the boiler section and cannot be easily removed. Under this overloaded condition heat transfer to the boiler tubes is inefficient and the spaces between the tubes are narrowed restricting air flow, whereby the gas capacity and therefore the air in-put to the furnace are both diminished. The reduced air in-put results in chemically reducing conditions in the furnace and the gaseous sulphur compounds are in the form of hydrogen sulphide, methylmercaptan, etc. thus creating a substantial odour problem. Under sustained conditions of overload the boiler tube section becomes so badly fouled that it is necessary to shut and clean the furnace.

Recovery furnaces are normally installed with sufficient capacity to take care of the designed pulping capacity of the mill and often even with slight excess capacity to allow for some further expansion in the production of pulp. But as demand for pulp increases, pulp production is gradually expanded and sooner or later the point is reached where the furnace becomes overloaded and further expansion of pulp production is impossible without additional recovery capability. But the cost of installing a new recovery furnace is such that only a furnace above a certain size makes economic sense. Hence the paradox that while pulp production can be increased in relatively small increments, say by increments of 60 – 70 tons per day (e.g. by batch operation), expansion of recovery capacity proceeds by increments of a different order of magnitude, such as 300 tons per day and higher. It will be appreciated that to operate a furnace under protracted conditions of overload not only entails economic losses but will also greatly increase the risk of emission of malodorous sulfur compounds and of violating the environmental protection standards set by the regulatory agencies. This acts as a special constraint on the liquor handling capacity of existing furnaces.

An alternate mode of operating under overload pulping conditions is simply to sewer the excess black liquor. This alternative results in loss of chemical and recoverable heat and has a deleterious effect on BOD, color and toxicity of the receiving water. Installation of a biological lagoon reduces the BOD content of the discharge but has no beneficial effect on colour or inorganic chemical loss. The present invention allows burning this excess liquor in an auxiliary incinerator such as a fluid bed combustion unit recovery for generation of steam and reuse of the inorganic chemical.

It will be apparent from the above that a Recovery Furance is in fact a relatively complex chemical reactor requiring accurate control of conditions in the various zones to insure proper reacting conditions and minimize emissions from the furnace.

A fluidized bed incinerator, on the other hand, is a simple incinerator type apparatus wherein black liquor is injected into an oxidation zone thereby to completely burn off the organic matter and to produce an inorganic residue in the form of solid pellets that are continuously removed from the fluidized bed. The temperature in the oxidation zone is controlled below the fusion point of the sodium salts (the temperature generally being in the order of 1300° F) by simply regulating the amount of water entering the incinerator (i.e. the concentration of the black liquor). This may be compared with the high temperature of the oxidation zone of the Recovery Furnace (in the range of about 2000° to 2200° F) and the temperature control by the complicated and expensive water wall construction. The lower temperature in the fluidized bed not only reduces the volatilization of sodium salts but because the salts are in solid phase the hazard of slagging on the boiler tubes is totally eliminated.

When sodium and sulphur containing residual pulping liquors are burned in a fluidized bed incinerator the inorganic material withdrawn from the system consists of sodium carbonate and sodium sulphate. It has not been found possible to obtain complete combustion of the organic matter while at the same time to have the sulphur compounds in the inorganic material reduced to sodium sulphide in the fluid bed incinerator. Thus, although it is desirable to oxidize the extra liquor that would otherwise overload the furnace, in a separate oxidizing unit this can only be done if a suitable means for reducing substantial quantities of the resultant oxidized product is available.

It is known to burn waste liquor from a neutral sulphite cook in a fluidized bed combustion unit of the type disclosed, for example, in Canadian Pat. No. 739,865 to recover the residual inorganic materials in the form of agglomerates containing essentially sodium sulphate and sodium carbonate and to add these agglomerates to the black liquor of the Kraft process and feed them to the recovery furnace as solids in the concentrated black liquor. The quantity of this type of pellet that may be used is limited to the amount of chemical required as make-up for losses incured in the pulping and recovery system.

It has been suggested in order to relieve the overloaded conditions of the furnace to burn a portion of the Kraft waste liquor in a fluidized bed furnace to form agglomerates containing sodium sulphate and sodium carbonate and to add these agglomerates to the black liquor and feed it to the Recovery furnace in the manner referred to hereinabove with respect to the neutral sulphite liquor. However, there is a very distinct limit as to the amount of pellet material that may be introduced to the furnace with the black liquor. Black liquor at about 65% solids is normally introduced to the furnace as a spray which is either "plastered" onto the wall of the furnace where the char is formed or, alternatively, is injected in controlled size droplets to ensure that all of the water entering with the black liquor is evaporated as the droplets fall from the oxidation zone towards the hearth (it is extremely important to ensure that water in any substantial quantities does not reach the hearth). Only limited quantities of the inorganic material thus may be added to the black liquor without disturbing the operation of the furnace. It must also be held in mind that additional inorganic matter obtained from separate combustion of the black liquor would be in addition to the normal make up of sodium sulphate which further reduces the capacity of the black liquor to carry the pellets through the spray into the furnace. The pellets consist of sodium sulphate and sodium carbonate with the sulphate the minor constituent. The sodium carbonate, which does not have to be chemically reduced, flows as a dead load in the black liquor. Also the addition of the inorganic material to the relatively high temperature oxidation zone of the Recovery Furnace results, as above indicated, in volatization of more of the sodium which increases the emission problems of the furnace. To the applicant's knowledge, feeding of pellets derived from a Kraft liquor to the furnace with the concentrated black liquor has never been tried.

Thus, there are two main problems, one is to increase the production capacity of Kraft furnace, and the other is to provide a mechanism for chemically reducing in substantial quantities the agglomerates or pellets formed by fluidized bed oxidation of spent liquors. The present invention supplied a solution to both said problems.

SUMMARY OF THE INVENTION

It is an object of the present invention to provide a means for increasing the capacity of the conventional Kraft Recovery furnace.

It is a further object of the present invention to provide a system for recovering chemicals from black liquor oxidized in an oxidation zone external to the furnace e.g. in a fluid bed incenerator or combustion unit, by utilizing the processing capabilities of the Kraft furnace.

It is a further object of the present invention to provide a means for increasing the capacity of Kraft mill recovery system.

It has been found that if the agglomerates (pellets) produced in a fluidized bed by combustion of Kraft waste pulping liquors and containing $Na_2SO_4$ and $Na_2CO_3$ are introduced to a Kraft recovery furnace by injecting the pellets directly on to the char bed or hearth and into the reducing zone of the furnace the recovery capacity of the furnace may be increased substantially without disrupting the operation of the furnace.

Broadly the present invention comprises a method of increasing the recovery capacity of a Kraft recovery furnace having a reducing zone on the hearth at the bottom of the furnace and an oxidation zone spaced above said reducing zone, said method comprising introducing a concentrated spent black liquor containing sodium sulphate and sodium carbonate together with combustible organic material to said oxidizing zone thereby to oxidize said organic material, forming a char bed of residual carbon and inorganic sodium salts on said hearth, burning out said residual carbon, melting said sodium salts on said hearth in said reducing zone, injecting solid particles consisting essentially of sodium carbonate and sodium sulphate directly on to said char bed while maintaining the temperature and reducing conditions in said bed thereby to produce a smelt consisting essentially of sodium sulphide and sodium carbonate.

In the preferred arrangement of the present invention the capacity of an alkaline pulp mill is increased by oxidizing a portion of the black liquor in an external oxidation zone to burn off substantially all the organic constituents in the liquor and leave essentially only the inorganic constituents mainly sodium sulfate and sodium carbonate in the form of small particles or pellets. These pellets are injected directly onto the char bed on hearth of the furnace as described hereinabove. Preferably, the external oxidizing unit will be a fluidized bed furnace controlled to produce pellets or particles in the desired size range for feeding to the furnace - in some cases it may be necessary to further treat the pellets to increase their size to prevent entrainment of the pellets in the gases in the furnace.

The injection of solid particles of sodium sulphate and sodium carbonate recovered from incinerated liquor from the Kraft process directly onto the char bed on the hearth of the Recovery Furnace permits operation at chemical recovery rates well above normal levels without raising the temperature in the oxidation zone excessively. Thus, with the present invention the output of the furnace may be increased substantially without a major increase in the temperature in the oxidizing zone.

When the pellets are directed onto the hearth care must be taken to ensure that temperature and reducing conditions on the hearth are maintained so that the process may function normally i.e. the reducing conditions to form the sulphide and the temperature sufficiently high to form the smelt. If extra heat is required in the reducing zone this heat may be added, for example, by burning auxiliary fuel such as oil without causing major changes in the temperature in the oxidation zone. Alternatively, or in conjunction with the oil burners, slightly more oxygen may be added at the hearth level as primary air to transform more CO to $CO_2$ immediately above the char bed. However, care must be taken to ensure that the reducing atmosphere is maintained so that the sulphate will be converted to the sulphide on the hearth to form the smelt and to insure that sufficient $H_2$ and CO are available in the oxidizing zone to maintain the temperature in the zone.

The actual point of entry of the pellets into the furnace may be varied; however, it is preferred not to subject particles to the relatively high temperature in the oxidation zone since there will be a greater tendency to volatalize the sodium and increase the emissions from the furnace. It must be kept in mind that about 60% of the sodium emission are generated in the high temperature oxidizing zone of the furnace.

It is important that the pellets be of sufficient size and density that they are not entrained in the gas stream and carried out with the combustion gases. Thus, the size of the pellets or particles, while it may vary, should be large enough that there is a minimum amount of entrainment and yet not so large as to inhibit proper operation of the bed. Preferably the pellets will be as small as possible without incurring substantial amounts being entrained and of course compatible with the method of pellet formation.

The pellets should be added uniformly or as uniformly as possible over the whole surface of the bed. This may be obtained by blowing the particles into the furnace preferably adjacent to the hearth and directing them toward the char bed in a uniform pattern over the total area of the char bed. Alternatively, the particles may be injected into the furnace in any suitable manner, for example, by means of the flinger mechanism which flings the particles in as required.

DESCRIPTION OF THE PREFERRED EMBODIMENTS

Figure 1:
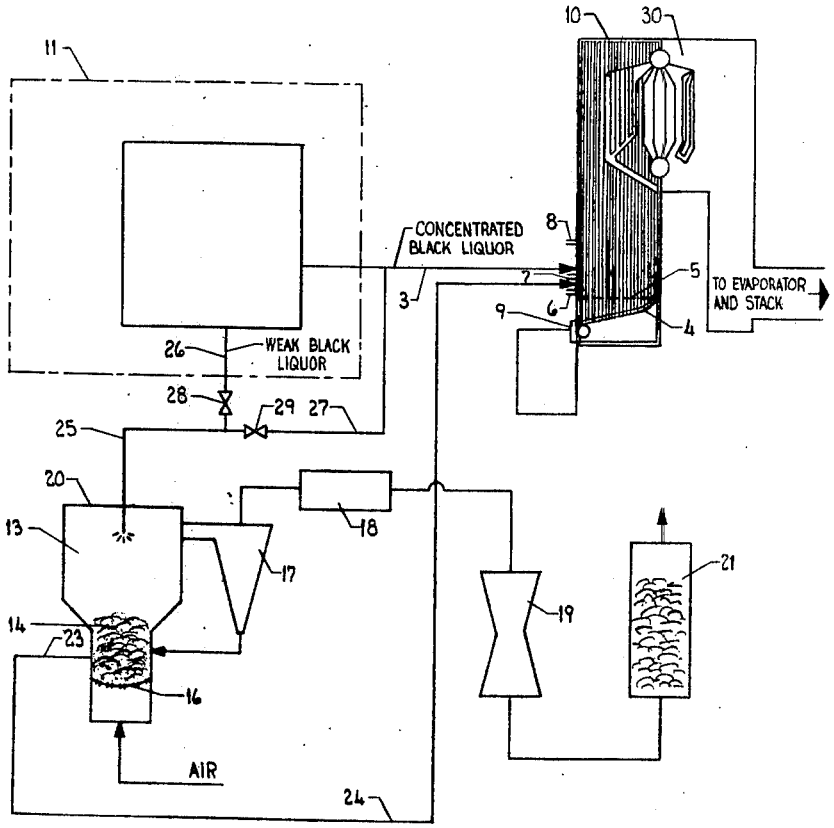

Further features and advantages will be evident from the following detailed description of a preferred embodiment of the present invention taken in conjunction with the accompanying drawings in which FIG. 1 is a schematic illustration of the preferred embodiment of invention applied to the recovery system for a Kraft Mill.

The highest temperature in the reducing zone will occur at the top of the char bed on the hearth of the furnace. The maximum temperature in the furnace is found in the oxidation zone. The difference in temperatures at the top of the bed and the oxidation zone is dependent on the load conditions of the furnace. The temperature in the oxidation zone increases dramatically as the furnace is overloaded while the temperature at the top of the bed rises more slowly thereby resulting in a substantial difference between these temperatures under overload conditions. The increase in temperature is due to combustion of the $H_2$ and CO gases evolving from the reducing zone of the furnace and being oxidized in the oxidation zone ($2CO + O_2$ yields $2CO_2$ and 4,400 b.t.u. per pound while $2H_2 + O_2$ yields $2H_2O$ and 52,000 b.t.u. per pound both at 25° C). The extra CO and $H_2$ generated on the hearth from the added organic in the extra black liquor fed to the furnace under conventional overload conditions is burned in the oxidation zone of the furnace and the heat released increases in temperature substantially. Higher temperatures in the oxidation zone cause more rapid volatilization of the sodium injected into the furnace in this zone which substantially increases the amount of sodium and sulphur emissions from the furnace. As explained above this excess heat is clearly detrimental to the operation of the equipment.

Referring to FIG. 1 an overall pulping system incorporating the present invention has been schematically illustrated. In this arrangement spent or black liquor generated in the pulping operation of a Kraft Mill designated generally by the number 11 is concentrated in the conventional manner, e.g. in a multiple effect evaporator followed by direct contact evaporator and the liquor is concentrated to about 65% solids. The concentrated black liquor fortified with make up chemical such as sodium sulphate is fed into the recovery furnace and burned. Sodium sulphate is not necessarily added to the black liquor, for example, if the sodium sulphate were agglomerated into suitable size pellets it could be added in the same manner as the pellets described hereinabove, or alternatively where the Kraft mill is operated in conjunction with a semi-chemical process such as the NSSC process and pellets formed by oxidizing spent liquor from this process are available, the make-up chemical may be supplied by adding pellets formed by oxidizing liquor from the semi-chemical process and injecting these pellets directly onto the hearth as described hereinabove.

In some cases as described above some of the make-up chemical will be added as sodium hydroxide to the white liquor.

The black liquor is introduced to the recovery furnace at 3 through pressure nozzles which spray the liquor onto the inner surface of the walls were the liquor is dehydrated and forms a char which falls by its own weight onto the hearth 4 located on the floor of the furnace and thereby forms porous-burning char bed 5. Primary air is admitted at 6 in carefully controlled amounts well below the theoretical amount for total combustion to ensure that a reducing atmosphere is maintained above the char bed. This is necessary to reduce as much sulphate as possible to sodium sulphide. Secondary, and if necessary, tertiary air is added respectively at 7 and 8 to complete the combustion of the gases, a large part of them carbon monoxide, which rises from the char bed and generally to ensure proper heat recovery from the combustion of the organic constituents of the liquor. Hot gases from the furnace are passed into the boiler section 30 if the furnace and are used to generate high pressures steam. These hot gases can be further utilized to recover heat in direct contact evaporators or the like. The inorganic sodium salts essentially carbonate and sulphide are discharged from the bottom of the furnace at 9 as a molten stream (smelt) which is dissolved in water or weak liquor and further processed to generate white liquor.

A portion of the black liquor is diverted from the main recovery stream and directed via pipe 25 to a fluidized bed incinerator or combustion unit designated generally by the numeral 20. The liquor is introduced into the fluidized bed incinerator at a solid concentration of about 30–45% and the desired concentration is obtained, e.g. by mixing in appropriate proportions initial weak black liquor with strong black liquor from the evaporator, as shown in FIG. 2 by piping 26 and 27 with their valves 28 and 29, or by removing liquor from the evaporators at an intermediate stage of evaporation, or in any other known way. The liquor is introduced into the combustion unit as a spray, either through the freeboard space at 13 (as shown) or directly into the bed 14, while the bed is maintained in a state of fluidization by a steams of air entering through a plurality of nozzles in a dished distributor plate 16 upwards through the bed of particles. As the black liquor enters the combustion unit it loses water by evaporation and the thus further concentrated liquor, coming into contact with the moving particles of the fluidized bed, tends to settle on those particles as a coating or deposit. These particles are themselves inorganic residues of the combustion of black liquor.

The size of the pellets may be controlled within limits during their formation in the fluidized bed. Where possible it is preferred that the size of the pellets be adapted to ensure there is little entrainment of the pellets by the Recovery Furnace gases, provided this sizing of the pellets is compatible with proper operation of the fluidized bed. In some cases, depending on the liquor being treated it may be difficult if not impossible to control the size of the particle produced in the fluid bed at the required size for injection into the furnace and it may be necessary to further pelletize them to a size for injection into the furnace without being entrained in the furnace gases or to inject the pellet in a manner that this will not be substantial entrainment.

The pellets generated in the fluidized bed are usually substantially free of carbon and contain primarily a sodium sulphate/sodium carbonate mixture in a ratio depending on the ratio of the chemicals in the liquor being fired.

Preferably the pellets will be substantially spherical and will have a diameter in the range of about 0.3 to 2 millimeters to provide optimum compability with the operation of the Recovery Furnace.

The pellets are discharged continuously from the fluidized bed unit 20 at 23 by a screw conveyor and are fed to a pipe 24 through which they are conveyed preferably pneumatically to the Recovery Furnace 10. At the Furnace, as above indicated, they are injected onto the surface of the char bed and are spread as evenly as possible over the bed by suitable deflector means or the like (not shown). If is preferred to insulate the conveyor to reduce the heat loss from the pellets so they may be injected hot into the furnace and thereby conserve heat.

The combustion gases leaving the unit 20 are passed through a cyclone 17 to remove entrained particles (which are returned to the bed) and can then be used to recover heat such as in boiler 18. These gases may be further treated for environmental protection e.g. by passing through a direct contact verture scrubber 19, or the like, followed by a packed scrubber 21 and then released to atmosphere.

The above description has been directed primarily to a single mill such as the Kraft Mill operating at a higher capacity than that of the recovery furnace and provides a mechanism whereby the capacity of the pulp mill may be increased without necessitating the substantial investment required in replacing the furnace. As above indicated, pellets derived from other sources e.g. spent liquor from a NSSC cook may be injected into the furnace in the manner taught hereinabove to recover chemical value from the spent liquor from the semi-chemical pulping process to the extent necessary for use as make up chemical for the Kraft process. This arrangement would be particularly suitable where an NSSC mill and Kraft Mill were located on the same premises.

When combined with a black liquor spill collection system this invention eliminates the need for costly and inefficient biological oxidation of black liquor and instead allows recovery and return of heat and inorganic chemicals to the system while at the same time allowing adequate combustion air for the Recovery Furnace to operate with a minimum of air pollution problems.

The following is a specific example of a mill trial carried out using the present invention.

EXAMPLE

Pellets containing approximately 70% sodium sulphate and 30% sodium carbonate were injected into a Recovery Furnace through two tubes inserted into two secondary air ports. The solid pellets were injected into the furnace and fell onto the char bed using deflection plates to obtain good lateral spread of the pellets on the bed. Maximum flow rate of pellets in the test was approximately 70 pounds per minute.

During the test the total reduced sulphur emissions in the furnace exhaust gases remained substantially constant. Particulate emissions increased during the test but the total increase was not large and probably was attributable to the conditions of the test i.e. pellet injection system, conditions of the pellets, etc.

The smelt green liquor samples taken before and during the test were conventionally analyzed and the percent reduction did not significantly change during the test over what is normally experienced.

It will be noted that the above example uses pellets containing 70% sodium sulphate and approximately 30% sodium carbonate whereas the pellets from a conventional Kraft mill would contain approximately 25 to 35% sodium sulphate with the remainder being sodium carbonate. The same heat load on the furnace using pellets from a Kraft mill would permit the treatment of 150 pounds per minute of pellets from a Kraft mill or a pulping equivalent of 160 air dried tons per day. It will also be noted that this experiment did not establish the maximum amount of extra heat load that may be applied to the furnace.

As a comparison the rate of black liquor injection to the furnace during the test was at about the maximum for the furnace and amounted to the equivalent of a pulp production of 380 air dry tons per day. This test indicated that the chemical recovering capacity (reduction zone) could be increased by about 42% i.e. from about 380 to 540 air dry tons per day but did not establish the maximum amount of pellets that could be added.

Having disclosed the invention in detail modifications will be evident to those skilled in the art without departing from the spirit of the invention as defined in claims.

I claim:

1. A method of increasing recovery capacity of a kraft pulp mill without substantially increasing the emissions from a smelting kraft recovery furnace having a boiler section, comprising, cooking cellulosic material thereby to produce a kraft pulp, separating spent black liquor from said pulp, concentrating said black liquor, injecting a portion of said concentrated black liquor to an oxidation zone in said kraft recovery furnace whereby a char is formed and collected as a char bed on a hearth at the bottom of said kraft recovery furnace, maintaining a reducing atmosphere in said char bed, thereby to transform sodium sulfate contained in said spent black liquor to sodium sulfide, injecting a further portion of said spent black liquor to an oxidation zone external of said Kraft recovery furnace thereby to form pellets containing sodium carbonate and sodium sulfate from said further portion of said black liquor, injecting said pellets free from entraining liquid into said kraft recovery furnace and onto said char bed, said pellets being substantially spherical and sufficiently large so that there is no significant entrainment of the pellets by the furnace gases and yet small enough so that operation of the furnace is not disrupted to render the process inoperative, and maintaining a temperature and reducing conditions in said bed thereby to convert sodium sulfate in said pellets to sodium sulfide, and withdrawing a smelt of sodium sulfide and sodium carbonate from said kraft furnace.

2. A method as defined in claim 1 wherein said oxidation zone external of said furnace comprises a fluidized bed incenerator.

3. A method as defined in claim 1 wherein said pellets are substantially spherical and are between about 0.3 and 2 millimeters in diameter.

4. A method as defined in claim 1 wherein said pellets are injected into said reducing zone directly onto said char bed.

* * * * *